US006224250B1

(12) United States Patent
Kreinheder et al.

(10) Patent No.: US 6,224,250 B1
(45) Date of Patent: May 1, 2001

(54) MOBILE CEMENT ADDITIVE AND CONCRETE ADMIXTURE MANUFACTURING PROCESS AND SYSTEM

(75) Inventors: Mark Kreinheder, Long Beach, CA (US); Thomas Shea, Kensington, NH (US); Paul Westgate, Littleton, MA (US); Thomas Winkel, Westford, MA (US); James Gado, Concord, MA (US)

(73) Assignee: W. R. Grace & Co.-Conn., New York, NY (US)

( * ) Notice: Subject to any disclaimer, the term of this patent is extended or adjusted under 35 U.S.C. 154(b) by 0 days.

(21) Appl. No.: 09/485,812

(22) Filed: Feb. 15, 2000

Related U.S. Application Data

(63) Continuation of application No. PCT/US98/17441, filed on Aug. 21, 1998, which is a continuation-in-part of application No. 08/918,271, filed on Aug. 25, 1997, now Pat. No. 5,895,116.

(51) Int. Cl.[7] ..... B28C 7/04
(52) U.S. Cl. ..... 366/8; 360/16
(58) Field of Search ..... 366/2, 6, 8, 16, 366/17

(56) References Cited

U.S. PATENT DOCUMENTS

| | | | |
|---|---|---|---|
| 2,934,102 | 4/1960 | Martin | 141/21 |
| 4,298,288 | 11/1981 | Weisbrod | 366/8 |
| 4,406,548 | 9/1983 | Haws | 366/8 |
| 4,457,660 | 7/1984 | Pippinger | 414/332 |
| 4,553,573 | 11/1985 | McGarrah | 141/98 |
| 4,686,852 | 8/1987 | Ito et al. | 73/61 |
| 4,792,234 | 12/1988 | Doherty | 366/14 |
| 4,896,968 | 1/1990 | Baillie | 366/10 |
| 4,911,330 | 3/1990 | Vlaanderen et al. | 222/132 |
| 4,964,732 | 10/1990 | Cadeo et al. | 366/159 |
| 5,018,645 | 5/1991 | Zinsmeyer | 222/14 |
| 5,044,819 | 9/1991 | Kilheffer et al. | 404/72 |
| 5,171,121 | 12/1992 | Smith et al. | 414/332 |
| 5,203,629 | 4/1993 | Valle et al. | 366/2 |
| 5,785,421 | 7/1998 | Milek et al. | 366/33 |
| 5,895,116 * | 4/1999 | Kreinheder et al. | 366/8 |

OTHER PUBLICATIONS

ASTM Standards, Standard Specification for Ready–Mixed Concrete, 10 pages, May, 1994.

* cited by examiner

*Primary Examiner*—Tony G. Soohoo
(74) *Attorney, Agent, or Firm*—Craig K. Leon; William L. Baker

(57) ABSTRACT

A mobile system and process for manufacturing cement additives and/or concrete admixture products comprises at least two tanks each containing a different raw material for manufacturing cement additives or concrete admixtures; a frame for mounting and transporting as an integral unit at least two pumps operative to transfer the raw materials into a blender which mixes the raw materials together to provide a cement additive or concrete admixture for dispensing at the destination site, which could be the manufacturer's new or remote manufacturing site, or even a customer's site such as a cement plant or a ready-mix concrete plant. The frame can be placed upon or attached to wheels, as in a truck or trailer frame, and the tanks may also be placed on or secured to the truck or trailer frame. A preferred skid-mounted system comprises pumps, valves, meters, and a computer processor unit which can control the equipment and permit adjustments to be made at the destination site. Tanks of raw materials may be transported to a destination site together with or separately from the frame-mounted equipment, and finished products can be blended and adjusted on site by computer-controlled operation drawing upon inputted information parameters such as the quality of limestone, cement, aggregates, water, and also by drawing upon customer profile information (desired product blends, performance features, etc.) at the destination site.

25 Claims, 2 Drawing Sheets

MOBILE CEMENT ADDITIVE AND CONCRETE ADMIXTURE MANUFACTURING PROCESS AND SYSTEM

This is a continuation of application PCT/US98/17441, filed Aug. 21, 1998 which is a continuation-in-part of U.S. application Ser. No. 08/918,271, filed Aug. 25, 1997, now U.S. Pat. No. 5,895,116.

FIELD OF THE INVENTION

The present invention relates to the field of additives and admixtures for cement, concrete, mortar, and masonry, and more particularly to a mobile additive and admixture product manufacturing process and system that permits such additives or admixtures to be manufactured at a destination site, such as at a manufacturer's new or remote operations site or even at a customer's plant or site.

BACKGROUND OF THE INVENTION

It may be helpful to understand what is meant, first, by the terms "cement" and "concrete," and, consequently, what is meant by the phrases "cement additive" and "concrete admixture." The term"cement" is used generally to refer to Portland cement, which is a hydraulic cement, produced by pulverizing clinker consisting essentially of hydraulic calcium silicates, usually containing one or more forms of calcium sulfate as an interground addition. The term"hydraulic cement" refers to one that hardens by a chemical interaction with water. A "cement mortar" is a mixture of cement fine aggregate (e.g., sand), and water. However, the term"concrete" is used herein to refer to a mixture prepared from a cement (acting as a hydraulic binder), fine aggregate (e.g., sand), course aggregate (e.g., gravel), and water which is added to initiate the hardening of the cement binder.

A "cement additive" is a material used to facilitate the manufacturing of the cement or to improve its quality. Cement additives have several uses, for example, such as (1) grinding aids to enhance the efficiency of the mineral grinding process (including clinker) and to improve the flowability of the ground material, or to prevent phenomena known as "pack set" or "silo set"; (2) quality improvers to change the set time of the cement; (3) workability improvers to reduce the water demand of the cement and/or to increase its workability; (4) masonry/mortar additives to improve the workability cements intended for use in masonry applications (as well as to entrain air, increase water retention or board life, control set time, provide water resistance or increase strengths); and (5) slurry thinners to reduce the water content in raw material slurries.

A "concrete admixture" is a material other than hydraulic cement, water, and aggregates used as an ingredient of concrete or mortar and added to the concrete batch before, during, or after mixing and before hardening. Admixtures are used for modifying one or more properties of the concrete in such a way as to make it more suitable for a particular purpose or more economical.

Some of the major reasons for using admixtures are: (1) to achieve certain structural improvements in the resulting cured concrete; (2) to improve the quality of concrete through the successive stages of mixing, transporting, placing, and curing during adverse weather or traffic conditions; (3) to overcome certain emergencies during concreting operations; and (4) to reduce the cost of concrete construction. In some instances, the desired result can only be achieved by the use of an admixture. In addition, using an admixture allows the use of less expensive construction methods or designs and thereby offsets the costs of the admixture.

The term "concrete admixture" as used herein and after shall also mean and include admixtures for masonry concrete as well. A masonry concrete mix is one having a low moisture content. Some of the reasons for using a masonry admixture are: (1) to reduce the passage of water through the finished unit; (2) to improve the appearance of the end product; (3) to lower production costs; (4) to reduce production losses due to breakage; and (5) to reduce wear on the production machinery.

Typically, cement additives and concrete admixtures are sold as a "finished product" shipped in a tanker truck having a number of compartments containing other finished products, or they are shipped in dorms, in "totes" (e.g., 300 gallon plastic barrels), or in other bulk forms. The term "finished product" means that the additive or admixture is comprised of a blend of "raw material" components. Raw admixture materials, for example, may include lignosulfonate, corn syrup, an amine, etc. which is either mixed with water and/or another raw material.

SUMMARY OF THE INVENTION

The present invention provides a novel process and system for manufacturing finished cement additives and/or concrete admixture products at a destination site, such as at a customer's cement manufacturing plant or ready-mix concrete plant; or even at a new additive or admixture manufacturing site. A "destination" site may include, for example, a new or remote manufacturer's site, such as in another country, where manufacturing operations are being initiated by the manufacturer for the first time.

The mobile manufacturing system and process of the invention involve the use of a frame, preferably such as a "skid" (e.g., board or platform), on which at least two pumps are mounted, and optionally though preferably a blender, valves, and flow meters, such that these components can be conveniently transported to a destination site. Various tanks containing raw materials for manufacturing cement additive and/or concrete admixture products may be shipped together with the frame-mounted components, or separately, and then connected to the pumps at the destination site. The frame may itself be attached to, or function as, the frame of the vehicle; this may be accomplished simply by placing the frame or skid on wheels or on a truck frame, or using a truck frame to which the tanks, pump equipment, and wheels are mounted.

In exemplary embodiments in which the pumping equipment is placed on wheels, the invention will allow a manufacturer to custom blend cement additives and/or concrete admixtures, for example, at a remote destination site or at a customer's plant. The manufacturer can test and adjust the finished cement additive or concrete admixture product at the site, based on customer needs, quality control data and other factors. Use of quality control units permit monitoring of physical characteristics of finished product such as total solids, viscosity, specific gravity, pH, and other characteristics, and facilitates adjustments to the product, if needed, at the destination site.

The significance of the ability of the present invention to permit the manufacturer to dispense, blend, monitor, evaluate, and adjust the manufacturing process conveniently is bestowed by the ease whereby local variables such as the quality and type of hydraulic cement or limestone, aggregates, water, or other factors may be considered at the destination site. For example, a manufacturer can avoid spending time taking information or samples back to the usual manufacturing plant and then returning to a customer's site. The manufacturer can make quick and important adjustments to the raw materials, blending ratio(s), or physical characteristics of the final product at the destination site to conserve time, resources, and energy.

It is believed that the new capabilities of the present invention will have a profound impact in the cement and concrete industries. Customers will realize increased value in products and service through the manufacturer's enhanced capabilities in responding to different customer requirements and regional (and even plant-to-plant and site-to-site) variations.

An exemplary process of the invention for manufacturing cement additives or concrete admixture products comprises providing at a destination site a frame having at least two pumps for transferring the raw materials for manufacturing the cement additives and/or concrete admixtures to a blender, and providing at least two tanks of raw materials which are different from one another, whereby a finished product may be dispensed at the destination site. Further exemplary processes involve providing valves and meters for controlling and measuring the amount or flow rate of raw materials being pumped to the blender. In further exemplary embodiments, one or more quality control units, such as devices for measuring total solids, viscosity, pH, specific gravity, or other physical properties, can be mounted on the frame, so that the finished cement additive or concrete admixture product or even any raw materials can be monitored or adjusted.

Further exemplary systems and processes comprise using a central processing unit (CPU), such as a laptop, hand held unit, or process logic controller, which is in electronic communication with valves and pumps on the frame, and optionally one or more quality control units, to provide control and/or monitoring of physical characteristics of the finished cement additive products, concrete admixture products, or any of the raw materials. These can take place at the destination site to permit the finished product to be adjusted or modified.

Especially preferred is the use of a skid (e.g., a wooden, metal, plastic, or fiberglass board or platform) for mounting or securing at least two pumps for transferring raw materials from the tanks into a blender that is preferably also mounted on the skid. The skid can be sized for manual loading onto a truck or trailer, into a van, or into a carton or box for various modes of transport, such as by boat or airplane. The tanks containing various additive or admixture raw (or finished) materials may be shipped separately, or along with the skid, and otherwise handled individually.

In further embodiments, the skid or frame further comprises at least three or more sets of pumps, valves, and meters for controlling and monitoring the amount or flow rate of raw materials pumped into the blender. A computer processing unit (CPU) or process logic controller or other known control devices can be used for controlling and/or monitoring the operation of the various components. The CPU can be mounted on the frame or otherwise connected to pumps, valves, and/or meters through a junction box or serial bus mounted on the frame. The CPU can be programmed to control pumps and valves in response to output signals from the (flow) meters. The CPU may also be programmed with a customer profile information so that pumps can transfer the correct amount of raw materials to the blender to provide the final cement additive or concrete admixture product desired Other advantages and features of the inventive process and system of the invention will be further described hereinafter.

BRIEF DESCRIPTION OF THE DRAWINGS

A better comprehension of the following detailed description of exemplary embodiments of the present invention may be facilitated by reference to the appended drawing, wherein.

DETAILED DESCRIPTION OF EXEMPLARY EMBODIMENTS

Figure 1:
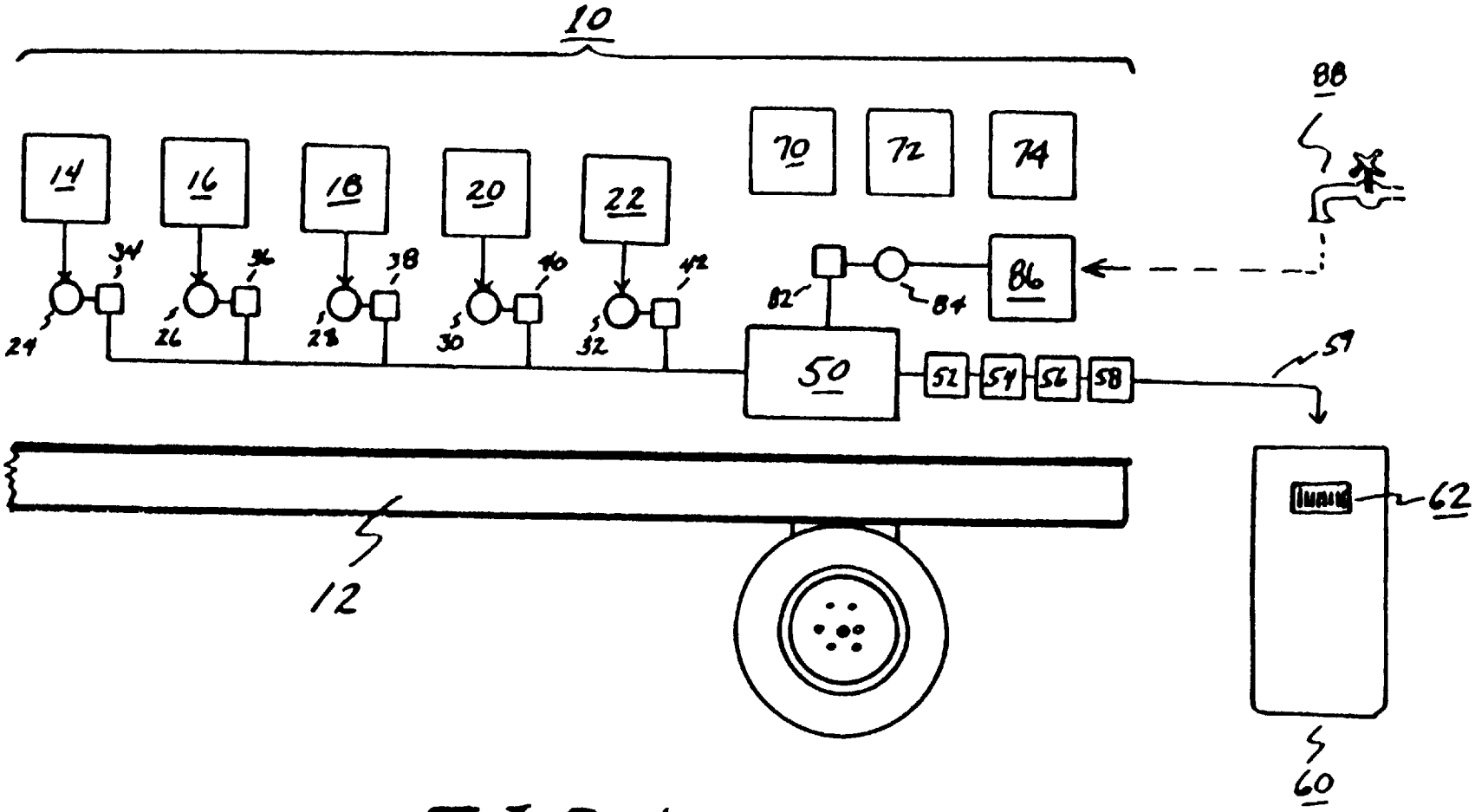
FIG. 1 is a schematic diagram of an exemplary mobile manufacturing system and process of the present invention.

As shown in FIG. 1, an exemplary process and system 10 of the present invention comprises providing on a frame 12 such as a truck frame, trailer frame, a skid (e.g., board or other movable or platform), or other mobile structure, two or more separate transport tanks (designated for example as at 14, 16, 18, 20, and 22) containing at least two raw materials for manufacturing cement additives and/or concrete admixtures, which are preferably provided in a liquid flowable form (in contrast to a dry particulate solid form). The contents of the at least two tanks are intended to be different from each other.

Cement additives and concrete admixtures are typically made by combining a "raw material" with water and/or another raw material to provide a "finished" product. Raw materials are generally known in the cement and concrete industries. For purposes of the present invention, exemplary "raw materials" include but are not limited to molasses, sulfonates (e.g., melamine sulfonate formaldehyde polymers, naphthalene sulfonate formaldehyde polymers), calcium chloride, sodium chloride, amines and alkanolamines, tall oil fatty acids, fatty acids and their derivatives, fatty esters and their derivatives, sodium gluconate, dyes, formic acid, sucrose, sugars, glucose, sodium nitrite, sodium nitrate, calcium nitrite, calcium nitrate (e.g., for making into solutions), calcium bromide, sodium thiocyanate, corn syrup, sodium sarcosinate, calcium or sodium lignosulfonate, lignin, alcohols (e.g., glycols and glycerols), phenols, alkanolamines and their acetate or formate salts, formic acid, acetic acid, anhydrous caustic soda, sodium hydroxide, potassium hydroxide, sodium linear alkylate sulfonate, formaldehyde, silica, a diglycinate, polymers containing oxyalkylene, calcium formate, formic acid, siloxanes, surfactants, resins and resin acids, and rosins and rosin acids, polyacrylic acid, polyvinyl pyrollidones, mixtures and derivatives of any of the foregoing. Further raw materials may be described hereinafter.

It is contemplated that transport tanks 14, 16, 18, 20, and 22 can be used for transporting and delivering at least two different raw materials, and preferably two to six or more different raw materials that can be blended with water and/or each other at the destination site to provide a finished cement additive or concrete admixture.

Figure 2:
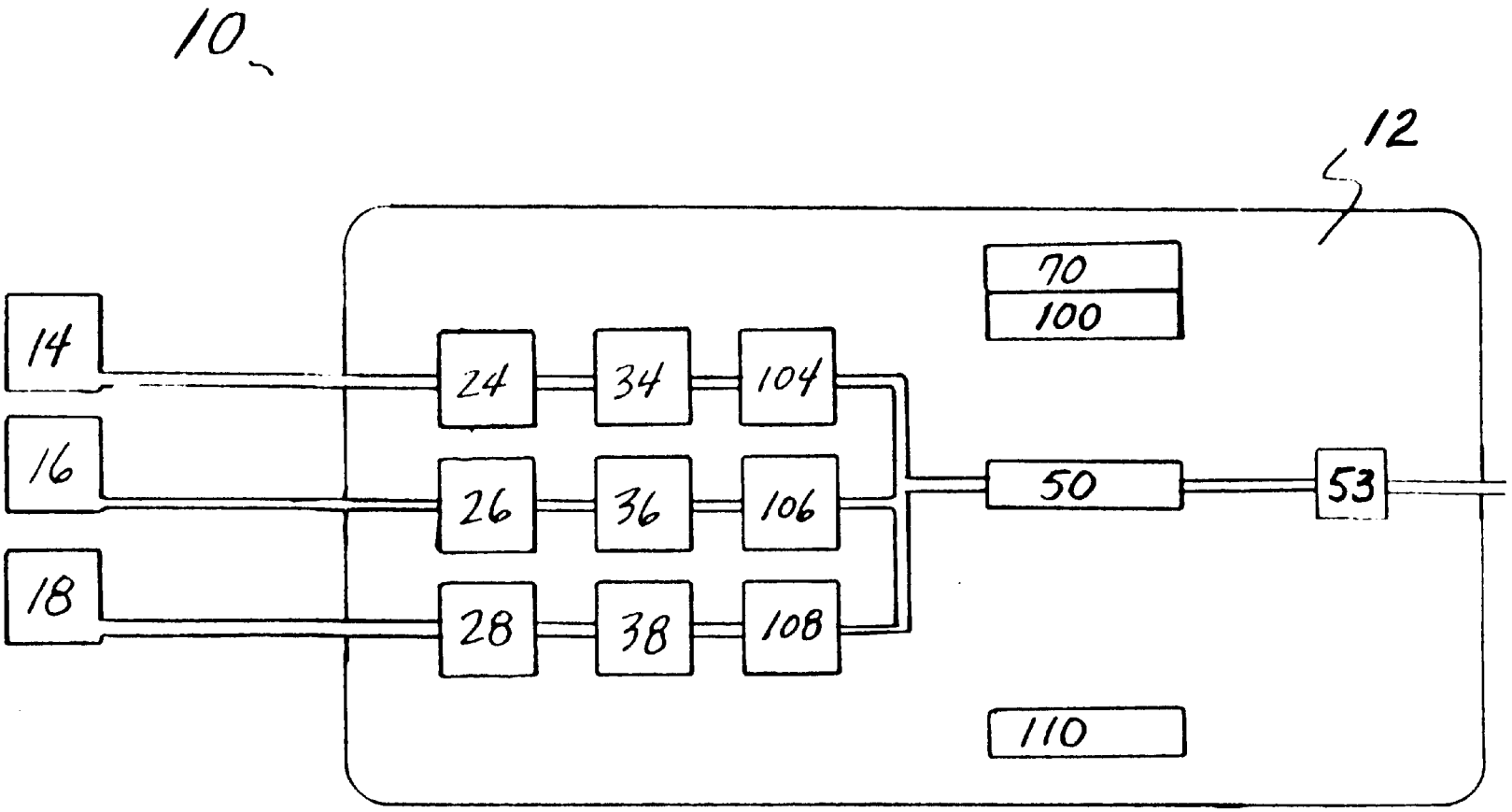
FIG. 2 is schematic diagram of a further exemplary mobile manufacturing system and process of the present invention.

The transport tanks can be fabricated from metal, plastic, fiberglass, or other material which is not degraded by the particular material contained therein. The term "tank" is used herein to designate a container which can be a barrel, box, bag, or even collapsible (partially flexible) structure. In embodiments of the invention wherein a skid-type frame is used for mounting pumps, at least one blender, and other equipment, the tanks may be shipped or transported separately to the destination site, and connected to the pumps by hoses or pipes. For example, FIG. 2 illustrates the use of pipes for connecting barrels or tanks of raw materials to various pumps (24/26/28) mounted on a skid 12.

A raw material component, such as one of the materials listed above, can be combined with water and/or another raw material component to provide a finished cement additive or concrete admixture product. Thus, for example, a water reducing admixture in the form of a "finished admixture product" can be manufactured by combining lignosulfonate, corn syrup, an amine, and water (sourced from the destination site). Another finished product may involve an adjustment in the concentrations of the various components; or additional materials, such as a surfactant and/or a biocide.

There may be instances in which a raw material can be dispensed directly into a holding tank at the customer site without having to be adjusted or diluted by addition of water or without being combined with another raw material. (However, this does not mean that a directly added material is thus not a "raw material" for purposes of the present invention).

As shown in FIG. 1, valve and/or pumping devices such as designated at 24, 26, 28, 30, and 32, are provided for feeding raw materials into a blender 50 where they are thoroughly mixed before being dispensed as final product into, for example, a delivery tank at the destination site (e.g., new or remote manufacturing facility) for subsequent shipment to a customer or directly into a customer's tank 60 located at the customer's site. The blender 50 may be a static design, such as an elongated compartment having internal baffles or structures for facilitating the mixing together of various raw materials fed by the pumps (24, 26, etc.), or it can be a motorized shear mixer type that may optionally be computer controlled (50).

In further exemplary embodiments of the invention, at least one quality control unit, such as a total solids measuring device 52, pH measuring device 54, viscosity measuring device 56, and/or specific gravity measuring device 58, is employed for ascertaining, determining, measuring, and/or confirming physical characteristics of the final cement additive or concrete admixture product, or of one or more of the raw materials used for making the product. Final additive or admixture product can be thus checked before or after being dispensed into the customer's holding tank 60 or into a further tank to be shipped to a customer. A pipe or hose 59, which preferably has a kill-switch connected to the blender 50 or valve or pump (not shown) leading from the blender 50, can be used to dispense raw materials or finished products at the destination site.

Cement additives and concrete admixtures are often classified by function, and it may help to provide a brief discussion of additive and admixture categories and the kinds of materials which are often used as the common raw material components in these categories. (Examples of concrete admixtures are provided in large part in U.S. Pat. No. 5,203,629 of Valle et al., incorporated by reference herein).

Grinding aids are cement additives used for enhancing the efficiency of any mineral grinding process (including clinker), to improve the flowability of the ground material or to prevent pack set or silo set. Some of the common raw materials used are amines, alkanolamines, and their acetate or phenolate salts, glycols, and polyacrylic acid.

Quality improvers are cement additives used for changing the set time of cement or other minerals to increase their early or late strength, to allow clinker substitution with fillers or to allow lower production costs through specific surface area reductions (e.g., Blaine surface area). Common raw materials include various alkanolamines and their corresponding salts, sodium or calcium chloride and certain carbohydrates.

Workability improvers are cement additives used for reducing the water demand of cement or to increase its workability. Common raw materials include lignins, sodium gluconates, lignosulfonates, naphthalene sulfonates, and polyacrylic acid polymers having oxyalkylene groups.

Masonry and mortar additives are cement additives used for improving the workability of cements intended for use in masonry applications. Such additives are also used for entraining air, increasing water retention or board life, controlling set time, providing water resistance or increasing early and/or late strengths. Common masonry/mortar additive raw materials include salts of wood resins, fatty acids, tall oils, and polymers such as polyvinyl acetate, polyvinyl alcohol, hydroxypropyl substituted polysaccharides, or mixtures thereof.

Slurry thinners are cement additives used for reducing the water content in raw material slurries used in the production of cement. Common raw materials include lignosulfonates, lignin, and sodium gluconates.

Accelerators are cement additives or concrete admixtures (depending on the application) used for accelerating the setting and early strength development of cement or concrete. Some of the common raw materials that can be used to achieve this function are calcium chloride, alkanolamine (e.g., triethanolamine), sodium thiocyanate, calcium formate, calcium nitrate, calcium nitrite, potassium nitrate, potassium nitrite, sodium nitrate, and sodium nitrite.

Retarding, or delayed-setting, additives or admixtures are used to retard, delay, or slow the rate of setting of cement or concrete. Retarders are used to offset the accelerating effect of hot weather on the setting of mortar or concrete, or to delay the initial set of mortar, concrete, or grout when difficult conditions of placement occur, or when problems of delivery to the construction site arise, or when time is needed for special finishing processes. Most retarders also act as water reducers and can also be used to entrain some air into mortar or concrete. Common raw materials include lignosulfonates, hydroxylated carboxylic acids, lignin, borax, gluconic, tartaric, and other organic acids and their corresponding salts, and certain carbohydrates. A retarder manufactured under the brand name DARATARD® is available from W.R. Grace & Co.-Conn.

Air detrainers are additives or admixtures used to decrease the air content in cement or concrete. Tributyl phosphate, dibutyl phthalate, octyl alcohol. water-insoluble esters of carbonic and boric acid, and silicones are some of the common raw materials that can be used to achieve this effect.

Air-entraining additives or admixtures are used to purposely entrain microscopic air bubbles into mortar or concrete. Air-entrainment dramatically improves the durability of mortar and concrete exposed to moisture during cycles of freezing and thawing. In addition, entrained air greatly improves the resistance of mortar and concrete to surface scaling caused by chemical deicers. Air entrainment also increases the workability of fresh mortar and concrete while eliminating or reducing segregation and bleeding. Raw materials used to achieve these desired effects include salts of wood resin; (Vinsol resin); some synthetic detergents; salts of sulfonated lignin; salts of petroleum acids; proteinaceous material; fatty and resinous acids and their salts; alkylbenzene sulfonates; and salts of sulfonated hydrocarbons.

Alkali-reactivity reducers can reduce alkali-aggregate expansion of these reducers, and common raw materials include pozzolans (fly ash, silica fume), blast-furnace slag, salts of lithium and barium, and other air-entraining agents are especially effective.

Bonding admixtures are usually added to Portland cement mixtures to increase the bond strength between old and new mortar and concrete and include organic materials such as rubber, polyvinyl chloride, polyvinyl acetate, acrylics, styrene butadiene copolymers, and other polymers.

Water-reducing additives and admixtures are used to reduce the amount of mixing water required to produce mortar and concrete of a certain slump, to reduce the ratio of water and cement, or to increase slump. Typically, water reducers will reduce the water content of a mortar and concrete mixture by approximately 5% to 15%. (See Water Reducing admixtures discussed above).

Superplasticizers are high-range water reducers, or water-reducing additives/admixtures. They are added to mortar and concrete to make a high-slump flowing composition, thus reducing the water-cement ratio. These additives/admixtures produce large water reduction or great flowability without causing undue set retardation or entrainment of air in mortar and concrete. Among the common raw materials that can be used as superplasticizers are sulfonated melamine formaldehyde condensates, sulfonated naphthalene formaldehyde condensates, certain organic acids, lignosulfonates, and blends thereof. Superplasticizers may also include polyacrylic acid polymers having oxyalkylene groups are especially preferred, and are commercially available from W.R. Grace & Co.-Conn. under the tradename ADVA®.

Colorants may be natural or synthetic in nature, and can be used for coloring mortar and concrete for aesthetic and safety reasons. These coloring admixtures are usually composed of pigments, and common raw materials include carbon black, iron oxide, phthalocyanate, umber, chromium oxide, titanium oxide, and cobalt blue.

Corrosion inhibitors in concrete serve to protect embedded reinforcing steel from corrosion due to its highly alkaline nature. The high alkaline nature of the concrete causes a passive and noncorroding protective oxide film to form on the steel. However, carbonation or the presence of chloride ions from deicers or seawater can destroy or penetrate the film and result in corrosion. Corrosion-inhibiting admixtures chemically arrest this corrosion reaction. The raw materials most commonly used to inhibit corrosion are calcium nitrite, sodium nitrite, sodium benzoate, certain phosphate; or fluoroaluminates, and fluorosilicates.

Dampproofing admixtures reduce the permeability of concrete that have low cement contents, high water-cement ratios, or a deficiency of fines in the aggregate. These admixtures retard moisture penetration into dry concrete, and raw materials commonly used for making these admixtures include certain soaps, stearates, and petroleum products.

Gas formers, or gas-forming agents, are sometimes added to concrete and grout in very small quantities to cause a slight expansion prior to hardening. The amount of expansion is dependent upon the amount of gas-forming material used, the temperature of the fresh mixture. Raw materials include aluminum powder, resin soap, and vegetable or animal glue, saponin or hydrolyzed protein.

Permeability reducers are used to reduce the rate at which water under pressure is transmitted through concrete. Raw materials include silica fume, fly ash, ground slag, natural pozzolan water reducers, and latex. Pozzolan is a siliceous or siliceous and aluminous material, which in itself possesses little or no cementitious value. However, in finely divided form and in the presence of moisture, Pozzolan will chemically react with calcium hydroxide at ordinary temperatures to form compounds possessing cementitious properties, and thus is a common raw material for making permeability reducers.

Pumping aids are added to concrete mixed to improve pumpability. These admixtures thicken the fluid concrete, i.e., increase its viscosity, to reduce de-watering of the paste while it is under pressure from the pump. Among the common raw materials used for making pumping aids in concrete include organic and synthetic polymers, hydroxyethylcellulose (HEC) or HEC blended with dispersants, organic flocculents, organic emulsions of paraffin coal tar, asphalt, acrylics, bentonite and pyrogenic silicas, natural pozzolans, fly ash and hydrated lime.

Bacterial and fungal growth on or in hardened concrete may be partially controlled through the use of fungicidal, germicidal, and insecticidal admixtures (which may otherwise be altogether termed "biocidal" admixtures). The most effective raw materials for making these admixtures include polyhalogenated phenols, dieldrin emulsions, and copper compounds.

As previously discussed, the term "concrete admixture" also encompasses "masonry admixtures" for which many raw materials are already identified above. However, some additional masonry admixtures are worth noting here. Integral water repellents are used in masonry to reduce water passage through manufactured units (e.g., blocks, pavers, other units) produced from concrete having a low moisture content. More specifically, an integral water repellent is used for minimizing the transmission of water, by capillary action, from the outside face of the manufactured unit to the interior of the unit. A typical application is the use of integral water repellents within a concrete masonry unit used for building external walls. Some common raw materials for integral water repellents include calcium stearate, zinc stearate, and butyl oleate.

An efflorescence control agent is another masonry (low moisture concrete) admixture used for reducing the occurrence of efflorescence on the surfaces of manufactured units (e.g., blocks). Efflorescence is a whitish deposit or encrustation of soluble and non-soluble salts that forms when moisture moves through and evaporates on the masonry units. Common raw materials include calcium stearate, zinc stearate, butyl oleate, and tall oil fatty acids.

It is further contemplated that all known raw materials and finished cement additive and concrete admixture products may be used in the manufacturing process and system of the present invention, preferably in their liquid form. Thus, further exemplary systems and processes of the invention involve the use of water (represented by the faucet at 88 in FIG. 1) provided or sourced at the destination site (which could be the user's remote manufacturing facility or it could be a customer's site such as a cement grinding plant or concrete-ready mix plant), to adjust raw materials or finished product. Accordingly, a valving/pump 82 device and/or metering device 84, and optionally an on-board water holding tank 86, is provided on the frame for the purposes of allowing water 88 to be added (preferably at a controlled, monitored rate/amount) into the blender 50, to be combined with one or more raw materials, and/or to permit raw materials in the tanks or in the blender, or finished product, to be adjusted or modified, e.g., such that desired total solids, viscosity, pH, specific gravity, volume, and/or other physical characteristics can be provided according to a given specification, such as a customer's profile (e.g., desired requirements).

An exemplary process (as illustrated in FIG. 1) for manufacturing finished cement additive or concrete admixture product at a destination site comprises providing in separate transport tanks (e.g, 14, 16, and 18), optionally mounted or otherwise placed upon on a frame (12), containing at least two raw materials (and more preferably at least four raw materials) for manufacturing cement additive or concrete admixture; transporting the at least two raw materials to a destination site (for example attached to the frame 12 if placed or mounted on a truck, boat, or airplane); blending together the raw materials at the destination site; and dispensing a finished cement additive or concrete admixture product into a holding tank 60 or other container receptacle located at the destination site.

In other exemplary processes, one or more raw materials are metered into a blender (e.g., static mixer) 50 which permits the raw materials to blend together to provide a final cement additive or concrete admixture product in accordance with the customer's order. Preferably, a central processing unit ("CPU") 70, which is mounted on the frame (truck, skid, or trailer), or which is provided in the form of a "laptop" computer, a hand-held computer (e.g., such as that available under the "NORAND" trademark), or process-logic-controller, is electronically connected (e.g., by hard-working, remote control, or other known means) to valves and/or pump devices (e.g., 24, 26, 28, etc.) and metering (e.g., flow meter) devices (e.g., 34, 36, 38, etc.) so that the separate amounts and/or rates of raw materials dispensed from the transport tanks (14–22) can be monitored or tracked. For example, a customer profile or pre-order information can be stored in computer memory (e.g., a memory location designated as at 72) and accessed by the CPU 70 which can send appropriate signals to the pumps (24–32) and metering devices (34–42) so as to have the appropriate amounts of raw materials introduced into the blender 50 and/or directly into a customer's holding tank 60 or other container. The CPU may also be connected to pumping or metering devices for controlling the amount of water, which may be provided or sourced at the destination site 88, drawn into the blender 50, or, if need be, into any of the individual transport tanks (14).

In preferred processes and systems of the invention, the customer profile information can be transcribed as a bar code 62 that can be affixed to the customer's holding tank 60. Thus, the vehicle 12 operator can scan the bar code 62 into the CPU 70, which then accesses the corresponding customer profile and/or account information (stored in memory 72) and sends the appropriate signals to the appropriate valves/pumps 24–32 and/or metering devices 34–42. If the transport tanks do not contain the correct raw material or sufficient amounts of a desired raw material, the CPU 70 can trigger an audible and/or visual alarm to the operator, who will need to make adjustments or otherwise confirm the situation before proceeding to dispense the final product.

The CPU 70 is preferably connected to the quality control units to obtain indications from the total solids measuring device 52, pH measuring device 54, viscosity measuring device 56, and/or specific gravity measuring device 58 and provide visual indications on a monitor. The CPU 70 can be programmed to signal an alarm if the quality control units provide a signal that indicates that one or more of the physical characteristics of the customer's profile 72 or specifications are not being met; and the CPU can be programmed to send signals to the appropriate valve/pump (e.g., 24–32) or metering device (34–42) to shut off or increase the flow of a particular raw material 14–22 and correct the situation. The quality control units 52/54/56/58 are preferably located on the frame 12, and may be removable therefrom, if desired, so that they can be used to test the contents of the customer holding tank 60 as well.

In further exemplary systems and processes of the invention, the transport holding tanks (e.g., 14, 16, etc.) have volume sensing means which provide an indication of the volume of raw material in a transport tank or may provide a signal to the CPU 70 corresponding to tank volume. Thus, the CPU 70 may provide an indication, such as through a print-out or monitor display (not schematically illustrated) to the operator or driver regarding raw material levels (amounts remaining) in each of the tanks (e.g., 14, 16, etc.).

In further exemplary processes and systems of the invention, the manufacturer or operator may determine, such as before or after a given product manufacturing run or delivery assignment, whether the system or vehicle tanks have particular raw materials for satisfying the next run or customer's profile. For example, after a first delivery at a customer's site, an operator can ascertain whether current on-board inventory will be sufficient to meet the next delivery at that same site, or another customer's profile at another site. Such information may be stored 72 on the vehicle 12 or even obtained by transmission from a central dispatching office at another location. Alternatively, the CPU 70 can provide readings of current raw materials inventory on board the vehicle, and enable the operator to determine which next customer orders can be filled with current inventory, facilitating the ability of the operator to choose which of the next customer sites should be targeted for filling orders.

The process for filling a customer order may proceed, for example, by using the CPU (e.g., laptop) to calculate the batch size and confirm the raw material quantities on board, and provide an indication as to how much water is required. The operator can then fill an on-board water holding tank 86 or otherwise confirm, through sensing means in the tank 86, that sufficient water is at hand. After unblocking valves and connecting the appropriate hoses, the operator uses the CPU to initiate the manufacturing process. A set of instructions can be provided to the CPU either inputted directly or from the customer profile data storage 72 (which may be initiated by scanning the bar code 62), whereby a number of operations are initiated and monitored: such as the opening and closing of valves and/or the operation/speed of pumps; the flow rate of all raw materials: the total flow of the raw material or final cement additive or concrete admixture product into the holding tank 60; and any or all quality control functions (e.g., 52, 54, 56, 58) are also initiated and monitored.

In still further exemplary systems and processes of the invention, the CPU 70 is programmed with logic to permit step change addition (or decrease rate addition) of raw materials from any of the transport tanks 14/16/18/20/22 to meet end specifications. The CPU 70 can also be programmed to close valves, shut pumps, and/or provide visual and/or audible alarms if a desired condition (e.g., a quality control characteristic such as total solids, pH, viscosity, specific gravity, etc.) is not being met. Safety kill-switches can be installed near the laptop or hand-held control unit (e.g., 70) or at the end of the dispensing hose 59 to shut down the system 10 during an emergency or alarm.

After a successful delivery, the operator can use the system 10 to confirm raw materials remaining in the transport tanks (14,16, etc.). This can be displayed using the CPU 70 and conventional monitor or printer devices (not shown). Accounting software 74 can be implemented in preferred systems and processes to keep track of the identity and amount of individual raw materials or blends that may be contained in the transport tanks (e.g., 14, 16, etc.) required to fill an order, and the operator can provide an invoice or meter ticket which incorporates this information at the time of delivery. The meter ticket can be signed by the customer as a record of the delivery.

Still further exemplary systems 10 and processes of the invention incorporate the use of cellular communications to permit, for example, data and information concerning current raw materials inventory, customer profiles, delivery routes, meter ticket information, confirmations of delivery, and other information to be shared with other such systems 10 or even with a sales office, so that national or regional information (such as pertaining to customer orders, profiles, usage, problems if any) can be stored, transmitted, monitored. gathered, and/or analyzed. The system permits the operator to determine what formulation products can be produced with the remaining on-board inventory, and can confirm if next delivery is possible. The operator can then drive to the next customer site and repeat the process.

As shown in FIG. 2, another exemplary system 10 of the present invention provides further capabilities and flexibility in manufacturing cement additive and concrete admixture products at a destination site. The exemplary mobile concrete admixture manufacturing apparatus 10 or system comprises at least two, and preferably three or more, tanks (14, 16, 18) each containing a raw material different from the raw material contained in the other tank or tanks; a frame such as a skid 12 (e.g., wooden, metal, or plastic board, platform, or other frame) for mounting and transporting, as an integral unit, at least two pumps (e.g., 24, 26), each of which is operative to transfer raw material from the tanks into a blender 50, which may optionally be also mounted on the skid 12. A large number of tanks can be transported or shipped separately to the destination site. Conduits such as hoses or pipes are used for connecting the raw materials (e.g., 14, 16, 18) to the skid-mounted pumps (24, 26, 28), then to optional valves (34, 36, 38) and flow meters (104, 106, 108) and to the blender 50 (which is preferably mounted on the skid). The integral unit comprising the skid 12 and various pumps, mixer, and other component equipment (valves, flow meters) may thus be compact in size and convenient to use despite the interconnecting tubes and electrical wires (not illustrated in FIG. 2).

The skid 10 may also have an on-board power supply or converter 110 that is preferably connected to the pumps 24, 26, 28 and other equipment (valves flow meters. CPU, monitors, etc.) so that the system 10 can be used in remote areas where electricity is inadequate or unavailable. In further embodiments, the power supply 110 can involve a gas-powered engine or diesel for turning an AC power generator to provide electricity for electrical/electronic components. The engine may also be hooked to a hydraulic or pneumatic system for running the pumps or valves. In a truck-mounted system (FIG. 1), the truck or vehicle engine itself may be used for driving an electrical generator, or hydraulic or pneumatic system for running pumps and valves. A variety of approaches are therefore contemplated for powering and controlling the various components.

The skid 12 (as shown in FIG. 2) can be used for mounting at least two and preferably a plurality of pumps (24, 26, 28), one or more blenders (50) or mixers, and other optional equipment such as valves (34, 36, 38) for controlling the amount or rate of materials being pumped into the blender 50, meters (104, 106, 108) for metering or monitoring the amount or flow rate of materials being pumped, and an optional junction box 100 for electrically connecting the pumps, valves, and/or flow meters to a computer processing unit (CPU) 70 which is preferably also mounted on or secured to the skid 12 or otherwise electrically or electronically connectable to the rest of the system at the destination site. (The terms "electrically" and "electronically" are used synonymously herein even though the latter term may suggest the use of remote controls). The resultant skid-mounted system can be made small enough in size that it can be transported along with the tanks in the same kind or size of shipping cartons or barrels used for shipping the raw materials. The skid 12 can otherwise be placed in a van, trailer, boat, airplane, or on a flat-bed truck or trailer, or on other conveyance means for shipment to the destination site (e.g., remote manufacturing outpost).

The CPU 70 can be mounted on the skid 12 or conveniently connected on site by a junction box 100 or serial electrical terminal (bus) mounted on the skid.

The skid 12 preferably comprises at least one pump for pumping water supplied (shown in FIG. 1 but not in FIG. 2) at the destination site or customer site into the blender 50. For example, if a tank (18) is not connected, then the pump 28 can be connected by hose or pipe to a water faucet, and the optional valve 38 and flow meter 108 are useful for controlling the rate of water to the blender 50. The skid 12 may also have water filter units and/or water treatment units (e.g., for modifying hardness or softness) if needed.

The use of the frame or skid 12 for mounting the pumps, valves, flow meters, and blender will provide convenience because the separate components will not require substantial assembly after shipment or delivery to the destination site. The system will provide greater control over the manufacturing and blending process because the individual components can be selected, adjusted, and calibrated to work together efficiently as a system before they are sent to the destination site. The components also provide standardization in that the components may be more easily replaced or otherwise repaired because the entire component or parts therefore may be obtained from one vendor or source. In further exemplary embodiments, the pumps, blender, and optional valves and flow meter, and other equipment (e.g., quality testing units generally designated as at 53, power supply 110) can be electrically connected to the CPU 70 which is or can be programmed to operate the system and/or to a junction box 100 to which the CPU is or can be electrically connected for operating and/or monitoring the individual system components.

The components are preferably chosen, mounted, and arranged for maximum systems accuracy and/or efficiency. If the pump 24 is a positive placement pump (e.g., piston type), then the valve (34) and flow meter (104) are not essential, because piston pumps are more precise than other kinds of pumps, although the use of the flow meter might be advisable as a means for confirming the amount of material pumped and providing information to the CPU for customer billing purposes. Accuracy would be attained by the use of piston pumps because the precise volume of material pumped is calculated based on the number of strokes and volume displaced per piston stroke. Moreover, the flow of material stops when the piston stops so that valves are not necessary, and piston pumps have no gears to wear down. If the pump 24 is a positive displacement type (e.g., gear pump), then it would be preferable to use an open/close type valve (34) to ensure that the flow of material stops when the pump stops; and here a flow meter 104 is unnecessary but advisable since, again, it would provide a way of monitoring the flow rate or amount of material transferred by the pump 24 to the blender 50. If the pump 24 is a centrifugal type pump (e.g., constant speed type), then a valve 34 which is a control type valve (e.g., adjustable) should be used for controlling the amount of material being transferred by pump 24 to the blender 50; and, accordingly, a flow meter 24 is highly recommended for monitoring the transfer amount or flow rate of material pumped to the blender 50.

In a feedback system, a flow meter (such as designated at 104) would send an electrical output signal to the CPU 70 in proportion to the amount of material being pumped, and this output would be compared by the CPU 70 with the flow rate desired by the operator (as inputted into a computer memory location), and the CPU 70 would then send an appropriate electrical output signal to the pump 24 or control valve 34, thereby increasing or decreasing, and thereby adjusting, the amount or flow rate of material actually being pumped to the blender 50.

It is believed by the present inventors that the exemplary mobile additive and/or admixture manufacturing system will bring enormous positive benefits to the concrete and building industry with the potential for expanding it globally. For example, tanks of various raw materials and the skid-mounted equipment can be transported by truck, wagon, helicopter, boat, or other transportation means to a remote, desolate, or underdeveloped area or country. Variations due to the quality of the limestone mixed at a plant or the cement used at the site, the quality and nature of the fine aggregates (sand) and course aggregates (e.g., gravel) at the site, and the nature of the water (e.g., hardness or softness) would mean fewer problems for the manufacturer to worry about, since the computer could be programmed to take these factors into account.

In a preferred admixture manufacturing apparatus and method of the invention, the CPU 70 is electrically (or electronically) communicative with a first memory location into which are stored formulation parameters to enable the CPU to control the flow rate or amount of raw materials transferred by the pumps. The CPU is preferably electrically communicative with a second memory location into which are stored customer profile parameters (such as identity of particular raw materials desired, relative amounts of each component to be blended together to produce the desired finished product, etc.) to enable the CPU to control the flow rate or amount of raw materials transferred by the pumps in accordance with the specifications of the job or customer order.

It is possible to disconnect a raw materials tank from the system 10 and to hook up another tank containing a different raw material in order to make different cement additive or concrete admixture products from the same system; and, where to this is done, it is advisable to clean the pump/valve/flow meter circuit to prevent cross-contamination. This may be done such as by purging the hose or pipe in the particular line (or the entire system if desirable) by using compressed air and/or water. Preferably, one or more compressed air tanks can be kept on or near the skid or truck for this purpose. The use of a separate, dedicated air supply will enable clean-up operations to occur without interfering with the manufacturing operation of valves, pumps, or other components which may be pneumatically operated by compressor(s) on the truck or skid. In other words, it is preferable to isolate air sources used for cleaning operations and for manufacturing operations. An on-board pump used for providing water into the blender 50 may also be used for pressuring water for cleaning or purging purposes.

As modifications of the invention may be evident to those of ordinary skill in the art in view of the disclosure herein, the scope of the invention is not intended to be limited by the foregoing examples.

What is claimed is:

1. A transportable apparatus for manufacturing cement additives or concrete admixtures, comprising:

at least two tanks each containing a raw material for manufacturing cement additives or concrete admixtures, said two tanks containing different raw materials, said raw material contained in said at least two tanks being selected from the group consisting of molasses, sulfonate, melamine sulfonate formaldehyde polymer, naphthalene sulfonate formaldehyde polymer, calcium chloride, sodium chloride, amines, alkanolamines and their corresponding salts, tall oil, tall oil fatty acid, fatty acids and their derivatives, calcium stearate, zinc stearate, butyl oleate, fatty esters and their derivatives, sodium gluconate, dyes, formic acid, sucrose, sugars, glucose, sodium nitrite, sodium nitrate, calcium nitrite, calcium nitrate, calcium bromide, sodium thiocyanate, corn syrup, sodium sarcosinate, calcium or sodium lignosulfonate, lignin, alcohols, glycols, glycerols, phenols, acetic acid, anhydrous caustic soda, sodium hydroxide, potassium hydroxide, sodium linear alkyl sulfonate, formaldehyde, silica, diglycinate, polymers containing oxyalkylene, calcium formate, formic acid, siloxanes, surfactants, resins and resin acids, rosins and rosin acids, polyacrylic acid, polyacrylic acids having oxyalkylenes, polyvinyl pyrollidone, polyvinyl acetate, polyvinyl alcohol, polysaccharides, carboxylic acids, borax, organic acids and their corresponding salts, carbohydrates, phosphates, phthalates, water-insoluble esters of carbonic and boric acid, silicones, synthetic detergents, salts of sulfonated lignin, salts of petroleum acids, proteinaceous materials, fatty and resinous acids and their salts, alkylbenzene sulfonates, salts of sulfonated hydrocarbons, pozzolans, fly ash, silica fume, blast furnace slag, salts of lithium and barium, rubber, polyvinyl chloride, acrylics, styrene butadiene copolymers, carbon black, iron oxide, phthalocyanate, umber, chromium oxide, titanium oxide, cobalt blue, sodium benzoate, fluoroaluminates, fluorosilicates, vegetable glue, animal glue, saponin, hydroxyethylcellulose, organic flocculents, paraffin emulsion, coal tar, bentonite, silicas, fungicides, germicides, insecticides, and mixtures and derivatives of any of the foregoing;

a frame for mounting and transporting as an integral unit at least two pumps, each of which is operative to transfer raw material from said tanks into a blender;

said at least two tanks not being mounted on said frame;

said frame further having mounted or connected thereupon a blender, meters, and at least two valves, said blender being operative for receiving said raw materials transferred from said tanks and blending said raw materials together to provide a cement additive or concrete admixture product; said meters operative for metering the amount or rate of raw material transferred by said pumps into said blender; and said at least two valves for controlling the transfer, by said at least two pumps, of raw material from said at least two frame-mounted tanks to said blender; and said frame further having mounted thereupon a junction box for connecting a computer processor unit to said pumps; and said at least two tanks and said frame and frame-mounted pumps, blender, meters, and valves being operative to be shipped to a destination site and there assembled into a cement additive or concrete admixture blending system.

2. The apparatus of claim 1 wherein said frame is a skid.

3. The apparatus of claim 1 further comprising conduits selected from pipes or hoses whereby said at least two pumps on said frame are in communication with said at least two tanks containing said raw materials.

4. The apparatus of claim 1 wherein said cement additives manufactured using said apparatus are selected from grinding aids, quality improvers, workability improvers, masonry/mortar additives, slurry thinners, or a mixture thereof; and said concrete admixtures manufactured using said apparatus are selected from accelerators, retarders, air detrainers, air entrainers, alkali-reactivity reducers, bonding admixtures, water-reducing admixtures, superplasticizers, colorants, corrosion inhibitors, dampproofing admixtures, gas formers, permeability reducers, pumping aids, fungicidal admixtures, germicidal admixtures, insecticidal admixtures, or a mixture thereof.

5. The apparatus of claim 1 further comprising a computer processor unit electrically or electronically connected to said at least two pumps on said frame.

6. The apparatus of claim 1 further comprising a computer processor unit (CPU) that is electrically or electronically communicative with a first memory location into which are stored formulation parameters to enable said CPU to control the flow rate or amount of raw materials pumped by said at least two pumps on said frame.

7. The apparatus of claim 6 wherein said CPU is electrically or electronically communicative with a second memory location into which are stored customer profile parameters to enable said CPU to control the flow rate or amount of raw materials pumped by said at least two pumps on said frame in accordance with relative amounts of particular raw materials for cement additive or concrete admixture specified for a customer.

8. The apparatus of claim 6 further comprising a computer processor unit electrically or electronically connected with said at least two pumps on said frame, at least two valves on said frame, and at least two meters on said frame whereby the flow rate or amount of raw material being transferred by said pumps into said blender on said frame are monitored and adjusted.

9. The apparatus of claim 1 further comprising at least one pump on said frame for providing water at a destination site to said blender on said frame.

10. The apparatus of claim 1 further comprising, on said frame, at least three pumps, at least three valves, and at least three meters for metering the amount or flow of raw materials being pumped into said blender.

11. The apparatus of claim 1 further comprising at least one quality control unit operative for measuring at least one physical quality thereof, said quality control unit being operative to measure total solids, viscosity, or specific gravity of a cement additive or concrete admixture or raw material.

12. The apparatus of claim 1 further comprising a pressurized air source for operating at least one component selected from valves and pumps on said frame.

13. The apparatus of claim 12 further comprising a second pressurized air source operative for cleaning said apparatus.

14. The apparatus of claim 1 wherein said tanks are plastic barrels.

15. The apparatus of claim 1 wherein said pumps are piston type positive displacement pumps.

16. The apparatus of claim 1 wherein said frame has mounted thereon a power supply, a converter, or combination thereof.

17. The apparatus of claim 1 further comprising a pump, valve and flow meter mounted on said frame for pumping and measuring water at the destination site.

18. A method for manufacturing cement additives or concrete admixtures comprising:

providing at least two tanks each containing a raw material for manufacturing cement additive or concrete admixture, said two tanks containing different raw materials, said raw material contained in said at least two tanks being selected from the group consisting of molasses, sulfonate, melamine sulfonate formaldehyde polymer, naphthalene sulfonate formaldehyde polymer, calcium chloride, sodium chloride, amines, alkanolamines and their corresponding salts, tall oil, tall oil fatty acid, fatty acids and their derivatives, calcium stearate, zinc stearate, butyl oleate, fatty esters and their derivatives, sodium gluconate, dyes, formic acid, sucrose, sugars, glucose, sodium nitrite, sodium nitrate, calcium nitrite, calcium nitrate, calcium bromide, sodium thiocyanate, corn syrup, sodium sarcosinate, calcium or sodium lignosulfonate, lignin, alcohols, glycols, glycerols, phenols, acetic acid, anhydrous caustic soda, sodium hydroxide, potassium hydroxide, sodium linear alkyl sulfonate, formaldehyde, silica, diglycinate, polymers containing oxyalkylene, calcium formate, formic acid, siloxanes, surfactants, resins and resin acids, rosins and rosin acids, polyacrylic acid, polyacrylic acids having oxyalkylenes, polyvinyl pyrollidone, polyvinyl acetate, polyvinyl alcohol, polysaccharides, carboxylic acids, borax, organic acids and their corresponding salts, carbohydrates, phosphates, phthalates, water-insoluble esters of carbonic and boric acid, silicones, synthetic detergents, salts of sulfonated lignin, salts of petroleum acids, proteinaceous materials, fatty and resinous acids and their salts, alkylbenzene sulfonates, salts of sulfonated hydrocarbons, pozzolans, fly ash, silica fume, blast furnace slag, salts of lithium and barium, rubber, polyvinyl chloride, acrylics, styrene butadiene copolymers, carbon black, iron oxide, phthalocyanate, umber, chromium oxide, titanium oxide, cobalt blue, sodium benzoate, fluoroaluminates, fluorosilicates, vegetable glue, animal glue, saponin, hydroxyethylcellulose, organic flocculents, paraffin emulsion, coal tar, bentonite, silicas, fungicides, germicides, insecticides, and mixtures and derivatives of any of the foregoing:

providing a frame for mounting and transporting as an integral unit at least two pumps;

said at least two tanks not being mounted on said frame; and providing a blender for receiving said at least two raw materials pumped from said at least two tanks and blending said raw materials to provide a cement additive or concrete admixture, said frame further having connected thereupon a blender, meters, and at least two valves, said blender being operative for receiving said raw materials transferred from said tanks and blending said raw materials together to provide a cement additive or concrete admixture product; said meters operative for metering the amount or rate of raw material transferred by said pumps into said blender; and said at least two valves for controlling the transfer, by said at least two pumps, of raw material from said at least two tanks to said blender; and said frame further having thereupon a junction box for connecting a computer processor unit to said pumps; and said at least two tanks and said frame and pumps, blender, meters, and valves being operative to be shipped as an integral unit to a destination site and there assembled into a cement additive or concrete admixture blending system in combination with said at least two tanks not mounted on said frame.

19. The method of claim 18 wherein said method provides a cement additive selected from grinding aids, quality improvers, workability improvers, masonry/mortar additives, and slurry thinners; or a concrete admixture selected from accelerators, retarders, air detrainers, air entrainers, alkali-reactivity reducers, bonding admixtures, water-reducing admixtures, superplasticizers, colorants, corrosion inhibitors, dampproofing admixtures, gas formers, permeability reducers, pumping aids, fungicidal admixtures, germicidal admixtures, insecticidal admixtures, or a mixture thereof.

20. The method of claim 18 further comprising providing a computer processing unit for controlling said pumps and valves in response to signals from said meters.

21. The method of claim 20 further comprising providing a first memory location into which are stored formulation parameters to enable said computer process unit to control the flow rate or amount of raw materials transferred by said at least two pumps on said frame; and providing a second memory location into which are stored customer profile parameters to enable said computer processor unit to control the amount or flow rate of raw material pumped by said pumps into said blender on said frame in accordance with customer requirements.

22. The method of claim 12 further comprising cleaning at least one valve or pump mounted on said frame.

23. A process for manufacturing finished cement additive or concrete admixture product at a destination site comprising:

providing in a plurality of separate tanks different raw materials for manufacturing cement additives or concrete admixtures, said two tanks containing different raw selected from the group consisting of molasses, sulfonate, melamine sulfonate formaldehyde polymer, naphthalene sulfonate formaldehyde polymer, calcium chloride, sodium chloride, amines, alkanolamines and their corresponding salts, tall oil, tall oil fatty acid, fatty acids and their derivatives, calcium stearate, zinc stearate, butyl oleate, fatty esters and their derivatives, sodium gluconate, dyes, formic acid, sucrose, sugars, glucose, sodium nitrite, sodium nitrate, calcium nitrite, calcium nitrate, calcium bromide, sodium thiocyanate, corn syrup, sodium sarcosinate, calcium or sodium lignosulfonate, lignin, alcohols, glycols, glycerols, phenols, acetic acid, anhydrous caustic soda, sodium hydroxide, potassium hydroxide, sodium linear alkyl sulfonate, formaldehyde, silica, diglycinate, polymers containing oxyalkylene, calcium formate, formic acid, siloxanes, surfactants, resins and resin acids, rosins and rosin acids, polyacrylic acid, polyacrylic acids having oxyalkylenes, polyvinyl pyrollidone, polyvinyl acetate, polyvinyl alcohol, polysaccharides, carboxylic acids, borax, organic acids and their corresponding salts, carbohydrates, phosphates, phthalates, water-insoluble esters of carbonic and boric acid, silicones, synthetic detergents, salts of sulfonated lignin, salts of petroleum acids, proteinaceous materials, fatty and resinous acids and their salts, alkylbenzene sulfonates, salts of sulfonated hydrocarbons, pozzolans, fly ash, silica fume, blast furnace slag, salts of lithium and barium, rubber, polyvinyl chloride, acrylics, styrene butadiene copolymers, carbon black, iron oxide, phthalocyanate, umber, chromium oxide, titanium oxide, cobalt blue, sodium benzoate, fluoroaluminates, fluorosilicates, vegetable glue, animal glue, saponin, hydroxyethylcellulose, organic flocculents, paraffin emulsion, coal tar, bentonite, silicas, fungicides, germicides, insecticides, and mixtures and derivatives of any of the foregoing;

providing at least one blender mounted on a frame, said blender operative for mixing together at least two of said different raw materials;

said at least two tanks not being mounted on said frame;

providing meters on said frame for metering the amount or rate of said raw materials provided from some of said separate tanks to said at least one blender;

blending said raw materials to provide a finished cement additive or concrete admixture product to be dispensed at a destination site;

providing at least one quality control unit to measure at least one physical quality of a cement additive or concrete admixture product; and dispensing said cement additive or concrete admixture product into a tank at the destination site.

24. The manufacturing process of claim 23 wherein said destination site is a customer site.

25. The system of claim 23 further comprising at least one quality control unit for measuring total solids, viscosity, specific gravity, or a combination thereof.

* * * * *